US007607882B2

(12) United States Patent
Matalevich et al.

(10) Patent No.: US 7,607,882 B2
(45) Date of Patent: Oct. 27, 2009

(54) APPARATUS FOR THE TIMED PROCESSING OF BOOK BLOCKS FOR PERFECT BINDING

(75) Inventors: Joe Matalevich, Suffolk, VA (US); Hansjörg Schneeberger, Brittnau (CH)

(73) Assignee: Mueller Martini Holding AG, Hergiswil (CH)

( * ) Notice: Subject to any disclaimer, the term of this patent is extended or adjusted under 35 U.S.C. 154(b) by 510 days.

(21) Appl. No.: 11/245,446

(22) Filed: Oct. 7, 2005

(65) Prior Publication Data

US 2006/0076725 A1 Apr. 13, 2006

(30) Foreign Application Priority Data

Oct. 7, 2004 (EP) ..... 04405631

(51) Int. Cl.

| | |
|---|---|
| ***B65H 57/00*** | (2006.01) |
| ***B08B 9/08*** | (2006.01) |
| ***B07C 1/18*** | (2006.01) |
| ***B42C 13/00*** | (2006.01) |
| ***B65G 47/22*** | (2006.01) |
| ***B65G 15/00*** | (2006.01) |
| ***B65G 17/00*** | (2006.01) |
| ***B65G 29/00*** | (2006.01) |
| ***B65G 25/00*** | (2006.01) |

(52) U.S. Cl. ..... 414/789; 414/762; 414/763; 414/765; 412/10; 412/11; 412/13; 198/403; 198/408; 198/409

(58) Field of Classification Search ..... 412/9, 412/10, 11, 13, 37; 198/402, 408, 409; 414/758, 414/762–765, 789, 789.2, 794.1, 779, 783
See application file for complete search history.

(56) References Cited

U.S. PATENT DOCUMENTS

| | | | | |
|---|---|---|---|---|
| 2,865,517 | A * | 12/1958 | Alford | 414/766 |
| 3,633,727 | A | 1/1972 | Brenner | |
| 3,757,736 | A * | 9/1973 | Anderson | 118/59 |
| 3,908,836 | A * | 9/1975 | Ikeda | 414/788.4 |
| 4,249,847 | A * | 2/1981 | Tokuno | 414/798.9 |
| 4,613,268 | A * | 9/1986 | Capdeboscq et al. | 414/796 |

(Continued)

FOREIGN PATENT DOCUMENTS

DE 2 226 455 12/1973

(Continued)

*Primary Examiner*—Dana Ross
*Assistant Examiner*—Kyle Grabowski
(74) *Attorney, Agent, or Firm*—Venable LLP; Robert Kinberg; Leigh D. Thelen

(57) ABSTRACT

An apparatus for timed processing of book blocks for perfect binding includes a feed element to supply respective book blocks horizontally positioned with a spine facing in a feed direction of movement. A lifting device is arranged to receive the respective horizontally positioned book blocks from the feed element. The lifting device is pivotal about a horizontal axis and has an adjustably driven limit stop that forms a conveying end of the feed element. A gripper circulates on a traction element above the lifting device. The lifting device is pivoted about the horizontal axis into an upright position and operates synchronized with the movement of the gripper to lift the respective book blocks with the adjustably driven limit stop to transfer each respective book block to the gripper when the gripper is positioned over the book block in the lifting device.

17 Claims, 6 Drawing Sheets

U.S. PATENT DOCUMENTS 4,640,655 A * 2/1987 Jacobsen ..... 414/796.2
4,700,941 A * 10/1987 Shill ..... 271/151
5,318,398 A * 6/1994 Kojima ..... 412/18
5,358,372 A * 10/1994 Meredith ..... 414/778
5,427,225 A * 6/1995 Namba ..... 198/409
5,647,725 A * 7/1997 Kraus et al. ..... 414/799
5,743,374 A * 4/1998 Monsees ..... 198/403
5,879,129 A * 3/1999 Newnes et al. ..... 414/796.7
5,954,473 A * 9/1999 Folsom ..... 414/788.9
6,099,224 A * 8/2000 Uchida et al. ..... 412/9
6,142,288 A * 11/2000 Hotkowski et al. ..... 198/409
6,378,690 B1 * 4/2002 Pessina et al. ..... 198/414
2001/0014265 A1 * 8/2001 Holtmeir et al. ..... 412/5

FOREIGN PATENT DOCUMENTS

DE 34 13 222 A1 10/1985
EP 0 790 139 A1 8/1997

* cited by examiner

APPARATUS FOR THE TIMED PROCESSING OF BOOK BLOCKS FOR PERFECT BINDING

CROSS-REFERENCE TO RELATED APPLICATION

This application claims the priority of European Patent Application No. 04405631.5-2304, filed on Oct. 7, 2004, the subject matter of which is incorporated herein by reference.

BACKGROUND OF THE INVENTION

The invention relates to an apparatus for the binding of a book block. Such an apparatus comprises a parallel-driven, synchronized lifting device for transferring a book block to a gripper that circulates above the lifting device on a traction mechanism. The book block is supplied to the lifting device while positioned flat and with its spine facing (pointing in a feeding direction to) a limit stop.

Müller Martini Marketing AG, Zofingen, Switzerland, markets a small-scale perfect binder under the trade name Amigo Digital. This perfect binder successively feeds book blocks to a limit stop of a lifting device. The lifting device is arranged at the end of a feeding segment. The book blocks can be pivoted along the limit stop to an upright position, allowing the individual book blocks to drop into the opened jaws of a gripper on a circulating conveyor. During this operation, the lifting device moves synchronously with the circulating gripper and the book block in the gripper passes through the processing stations of the binder.

The disadvantage of the above-described machine is that once the book blocks have been moved to the upright position, the position of the book blocks and in particular the position of the individual signatures cannot be controlled during the subsequent tilting and dropping of the book block into an opened gripper. This reduces the production quality and reliability.

One proposed solution is to feed the book blockers up an inclined plane to the gripper. However, this would require a longer feeding segment and several additional processing cycles.

SUMMARY OF THE INVENTION

It is an object of the present invention to create an apparatus of the aforementioned type which avoids the aforementioned problems and permits an easy and simple transfer of a book block to a gripper on a conveyor.

The above and other objects are accomplished according to an exemplary embodiment of the invention wherein there is provided an apparatus for timed processing of book blocks for perfect binding, comprising: a feed element to supply respective book blocks horizontally positioned with a spine facing in a feed direction of movement; a lifting device arranged to receive the respective horizontally positioned book blocks from the feed element, the lifting device being pivotal about a horizontal axis and having an adjustably driven limit stop that forms a conveying end of the feed element; and a gripper that circulates on a traction element above the lifting device; wherein the lifting device is pivoted about the horizontal axis into an upright position and operates synchronized with the movement of the gripper to lift the respective book blocks with the adjustably driven limit stop to transfer each respective book block to the gripper when the gripper is positioned over the book block in the lifting device.

Thus, according to the invention a feed element with a corresponding lifting device has an adjustable limit stop, by which a supplied book block can be pivoted around a horizontal axis into an upright position and can be transferred with the aid of the adjustable limit stop to the gripper on the conveyor. Using this structure, the book blocks can be supplied to the lifting device while positioned flat and can be transferred unobstructed to a perfect binder. This eliminates at least one processing step of prior methods.

Furthermore, this structure results in a lower height for the apparatus.

This apparatus is suitable for use with a perfect binder, provided with a gripper that circulates along a circular or an oval path.

The lifting device is advantageously provided with a limit stop which can be pivoted around a horizontal axis for transferring a book block to a gripper on the conveyor. The limit stop can be adjusted for conveying the book block to the gripper to be perpendicular to the feeding direction of the book block. A movement of the limit stop lifts the book block into the gripper and can be started even before the arrival of a book block at the limit stop. The limit stop can furthermore be adjusted to fit the format of the supplied book block.

The limit stop is advantageously provided with projecting fingers that are spaced apart over the width of the feed element.

It is advantageous if the limit stop can be pivoted around a horizontal axis that is arranged below a conveying plane for the feed element, such that the lifting device can be moved out of and back into the feed element.

The fingers on the limit stop are advantageously arranged such that they can be disposed between two respective conveying sections of the feed element.

The limit stop is preferably connected to guide bars which are arranged at a right angle to the fingers.

The guide bars are advantageously arranged between the conveying sections of the feed element, so that the guide bars do not interfere with the movement of the book blocks. The book blocks are transported by the conveying sections.

The gripper may be operatively connected to a traction mechanism drive, by which the book block is conveyed from the upright position in an upward direction into the gripper.

The book blocks can be pivoted with the aid of the guide bars from a horizontal position on the feed element to an upright position, where they rest on their spine, by using a gearing that is operatively connected to the limit stop.

To prevent the book block from tilting to the side during pivoting, a guide element is spaced a distance from the guide bars forming the guide plane in order to support and guide the book block on the side opposite the guide bars.

A slider can be used to extend the guide element parallel to the guide plane formed by the guide bars which is particularly useful for small book block formats.

A traction mechanism drive is advantageously provided to adjust the distance between the guide plane formed by the guide bars and the guide element to correspond to the different thicknesses of the book blocks, thereby preventing the tilting.

BRIEF DESCRIPTION OF THE DRAWINGS

These and other features and advantages of the invention will be further understood from the following detailed description of the preferred embodiments with reference to the accompanying drawings to which we refer for all details not expressly mentioned in the text, wherein.

DETAILED DESCRIPTION OF THE INVENTION

Figure 1:
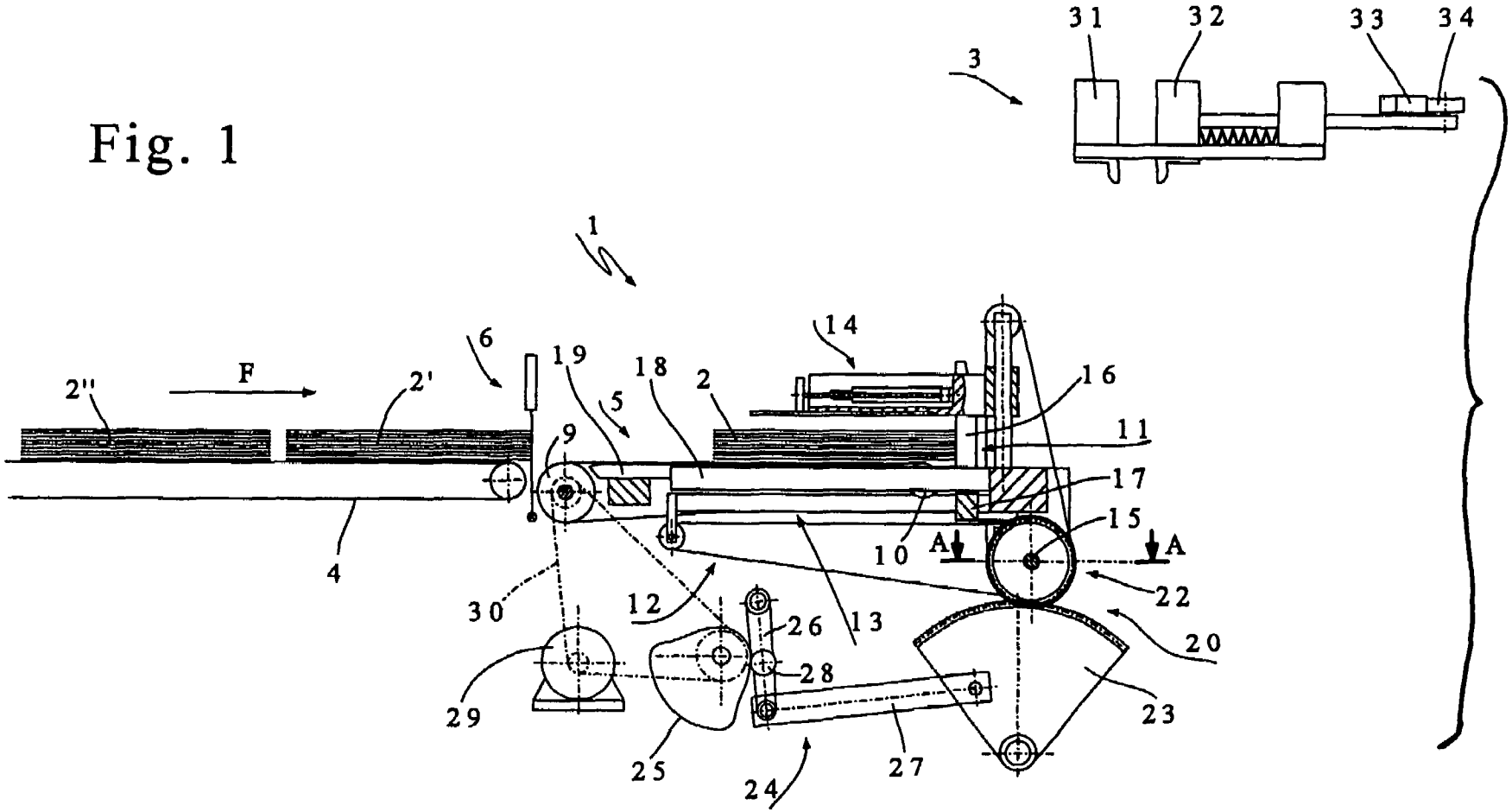
FIG. 1 illustrates a side view of an embodiment of the apparatus according to the invention, as well as a gripper for a perfect binder.
Figure 2:
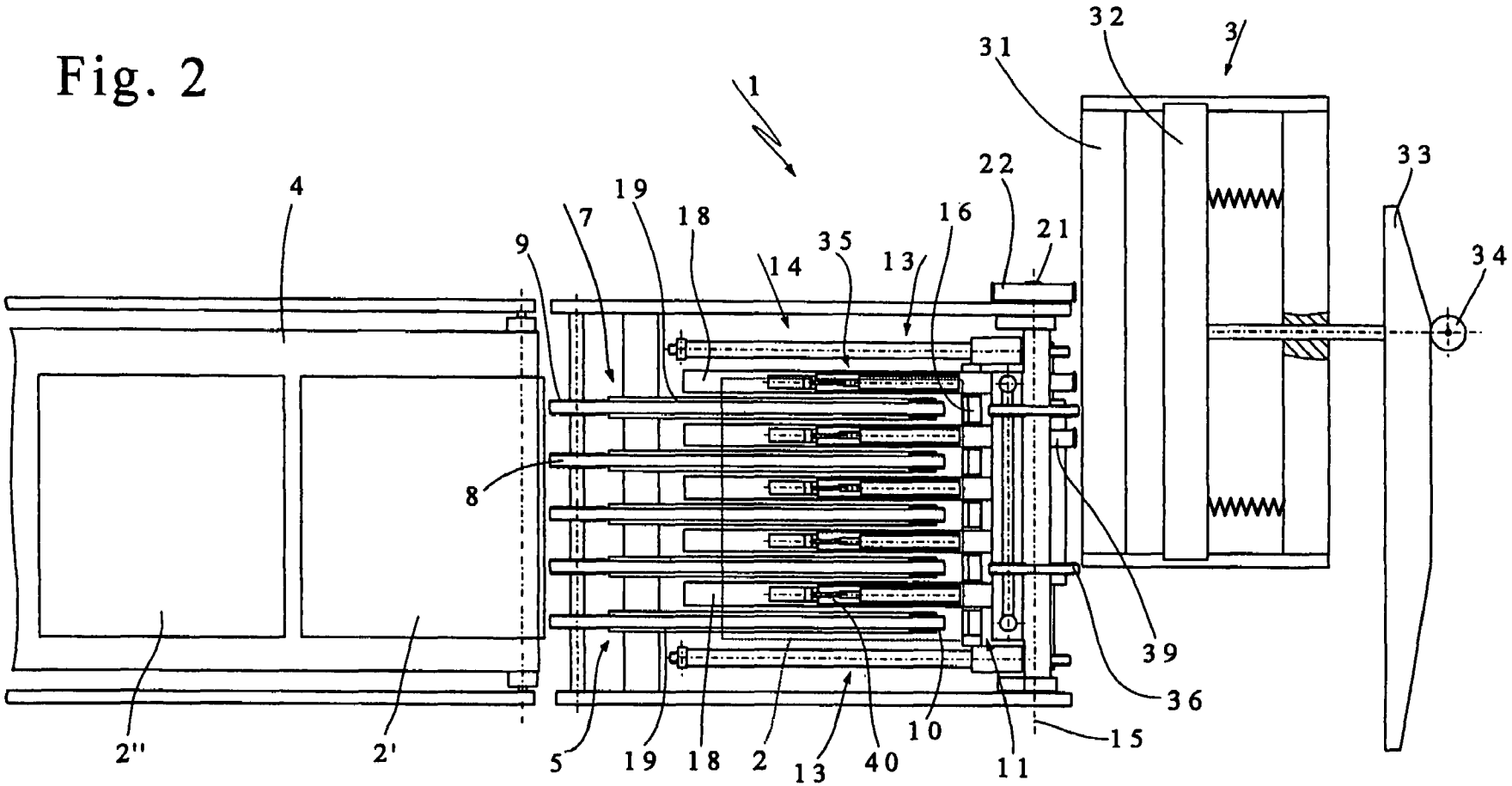
FIG. 2 illustrates a top view of the apparatus shown in FIG. 1.

FIGS. 1 and 2 depict an apparatus 1 for the binding of book blocks 2, by timed processing where the book blocks comprise at least one signature. FIGS. 1 and 2 furthermore show a gripper 3 that is attached to a traction mechanism for a circulating conveyor of a perfect binder. The book blocks 2 are supplied in conveyor direction F on a conveying belt 4 or the like for the apparatus 1. The book blocks are transferred in a timed operation and/or intermittently to a feed element 5. That is, the book blocks 2', 2" which follow a transferred book block 2, are stopped on the conveyor belt 4 until the apparatus 1 has transferred the book block 2 to the gripper 3 and has returned to the starting position as shown in FIG. 1. A light barrier 6 at a conveying end of the conveyor belt 4 detects the presence of the next book block 2'.

The feed element 5 comprises several (five according to FIG. 2) conveying elements 7 in the form of circulating belts 8. The circulating belts 8 are spaced apart side-by-side and arranged transverse to the conveying direction F (see FIG. 2). Two deflection rollers 9, 10 are provided for the circulating belts 8. The conveying sections of the belts 8 form a conveying plane. A deposited book block 2 is supplied in the conveying plane in direction F until it reaches a limit stop 11. The book block is arranged with a front edge of the book block 2 facing in the conveying or feed direction F. The limit stop 11, which is also provided for lifting up the upright book block 2 into the gripper 3, is operatively connected on both sides to a traction mechanism drive 12. The limit stop 11 can be displaced along the feed element 5 on a guide arrangement 13.

Figure 4:
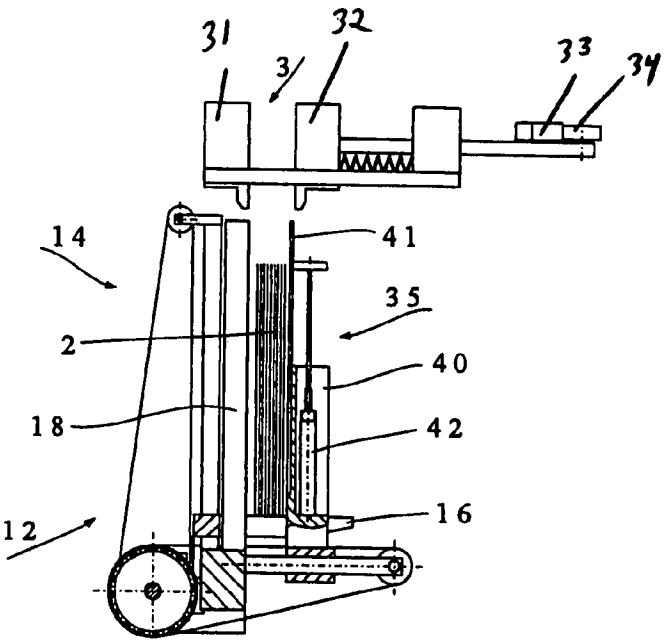
FIG. 4 illustrates a side view of the apparatus, with an extended guide element.
Figure 3:
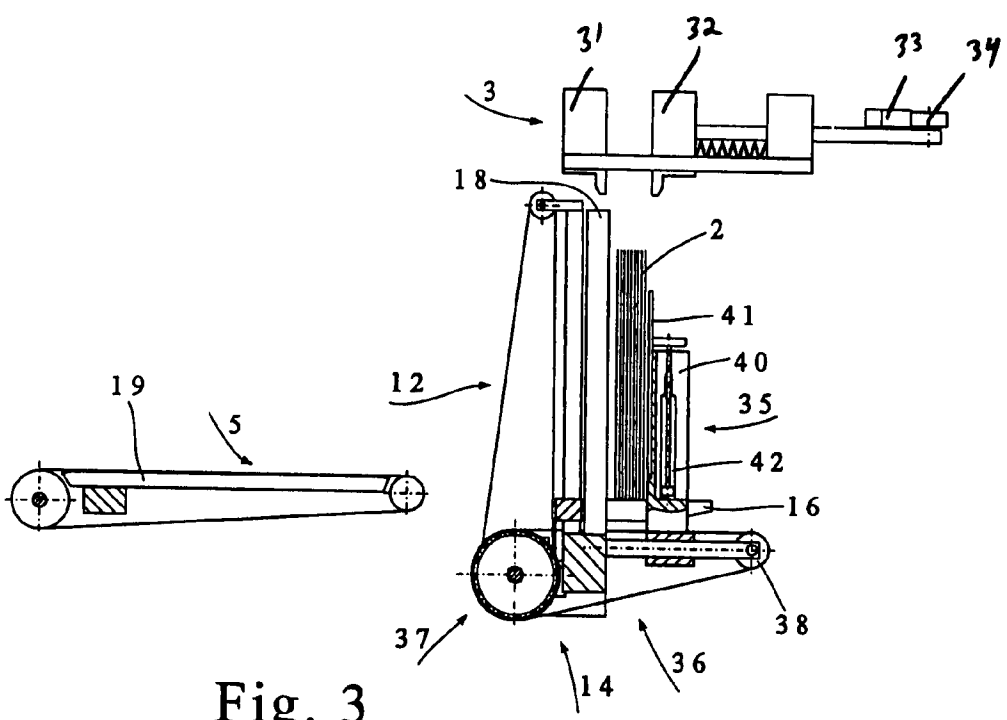
FIG. 3 illustrates a side view of the apparatus FIG. 1, with a pivoted lifting device.

In addition, the limit stop 11 can be pivoted around a horizontal axis 15, for example approximately 90°, so that the book block 2 that is present at the limit stop 11 rests approximately perpendicular thereon, with a spine of the book block against the limit stop (see FIGS. 3 and 4). For this, the limit stop 11 is provided with several fingers 16 which are evenly distributed over the length of the book block 2 spine and/or transverse to the conveying direction F. These fingers 16 are attached to a crossbar 17 that is operatively connected to the traction mechanism 12 and can be moved along the guide arrangement 13.

Fingers 16 are respectively arranged between two conveying elements 7 of the feed element 5. Guide bars 18 also extend between the conveying elements 7 and are connected to the crossbar 17 of the limit stop 11. When the book blocks 2 are supplied to the lifting device 14, the lifting device 14 is in a first position. The guide bars 18 are advantageously positioned below the conveying plane formed by the conveying sections of the conveying elements 7. The conveying elements 7 are supported on and slide along supports 19, so as to prevent the book blocks 2 from rubbing against the guide bars 18.

The lifting of the book blocks 2 by the guide bars 18, which are connected to the limit stop 11, starts with the lifting device 14 pivoting clockwise by 90° (see FIG. 3). Following this movement, the book block 2 is positioned perpendicular, meaning the book block is standing upright on the limit stop 11.

The pivoting movement is realized by means of a toothed-wheel gearing 20. The tooth-wheel gearing 20 comprises a toothed wheel 22 which is attached to a shaft 21. The shaft 21 is connected to the limit stop 11 and meshes with a toothed segment 23, driven so as to pivot. The toothed segment 23, in turn, is driven by a lever gear 24, provided with a lever arm 26. The lever arm 26 makes contact via a roller 28 with an endless control cam 25, as well as with a steering rod 27. The steering rod 27 is connected at one end to the exposed end of the lever arm 26 and at the other end to the toothed segment 23. An electric motor 29 for driving the feed element 5 is connected by a drive belt 30 to the control cam 25.

The gripper 3, which is shown schematically in FIGS. 1 and 2, is provided with an immovable gripper jaw 31 and a movable gripper jaw 32, shown in the opened position of the gripper 3. The opening of the gripper 3 is initiated by a roller 34 that is connected to the movable gripper jaw 32 and moves against the force of a spring to strike a control member 33.

The apparatus 1 moves parallel to and synchronized with the gripper 3 of the perfect binder for the transfer of the book block 2. In the process, the feed element 5 does not change its position within the apparatus 1, but the lifting device 14 lifts up the book block 2 and inserts it from below into the gripper 3. The synchronized operation of the apparatus 1 and the gripper 3 for the perfect binder starts as soon as a book block 2 is positioned on the feed element 5. Following receipt of the book block 2 by the gripper 3, the apparatus 1 moves back to the first position.

FIG. 3 shows the book block 2 pivoted to the upright position by the guide bars 18 on the limit stop 11 and resting on its spine. The book block 2 is guided by a guide element 35 to prevent tilting. The guide element 35 can be adjusted along the length of fingers 16 of the limit stop 11 to adapt the guide element 35 to the different thicknesses of the book blocks. The guide element 35 is provided with an additional traction mechanism drive 36. The traction mechanism drive 36 comprises two traction elements with respectively two reversing rollers 37, 38 and one drive wheel 39. A reversing roller pair 37 and the drive wheel 39 of the traction mechanism drive 36 have the same axis 15 as the toothed wheel 22 of the toothed wheel gearing 20.

The guide element 35 forms a supporting wall for the book block 2 in an upright position. The guide element 35 comprises several guide members 40 distributed over the length of the book block spine and can be adjusted and secured on the fingers 16 of the limit stop 11. If a book block 2 has a narrow width, the slider 41 can be used to extend the guide members 40. A pneumatically controlled pressure cylinder 42 is connected to the slider 41 for this.

Figure 5:
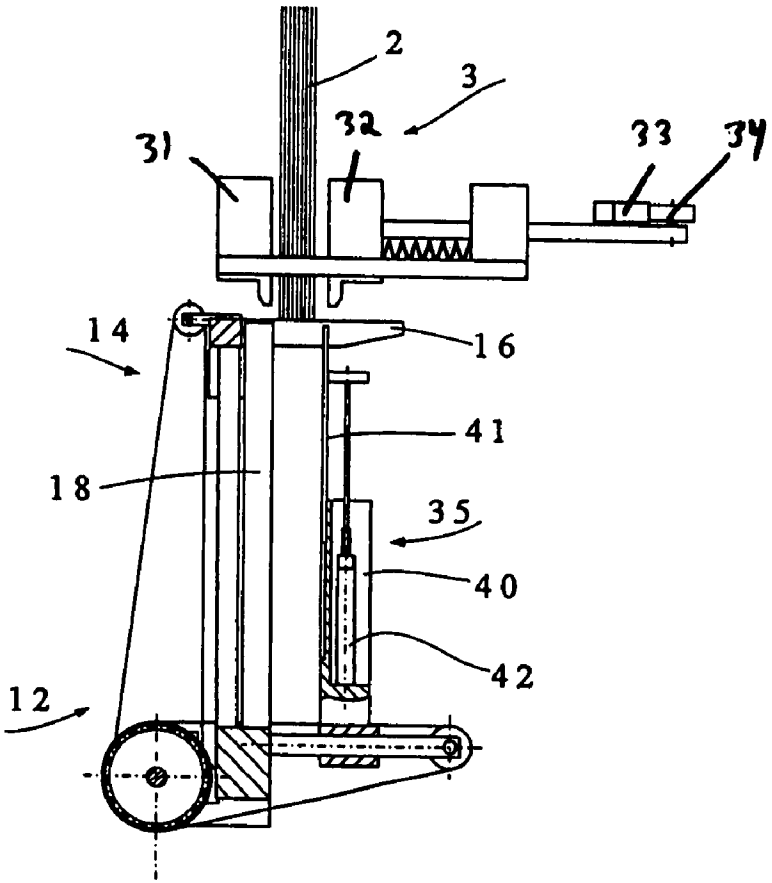
FIG. 5 illustrates a side view of the apparatus of FIG. 3 with a raised book block.

FIG. 3 furthermore shows the position where the book block 2 below the opened gripper 3 is ready to be transferred to the gripper 3. The book block 2 is lifted by the lifting device 14 during the parallel, synchronized operation of the feed element 5, lifting device 14 and the gripper 3. FIG. 3 shows the lifting device 14 in its second position. If a book block 2 with a narrow width is located between the guide bars 18 and the guide element 35, the sliders 41 of the guide members 40 are extended before the book block 42 is lifted into the gripper 3, so that the book block 2 is guided during the transfer into the gripper 3 (see FIGS. 4 and 5).

Figure 6:
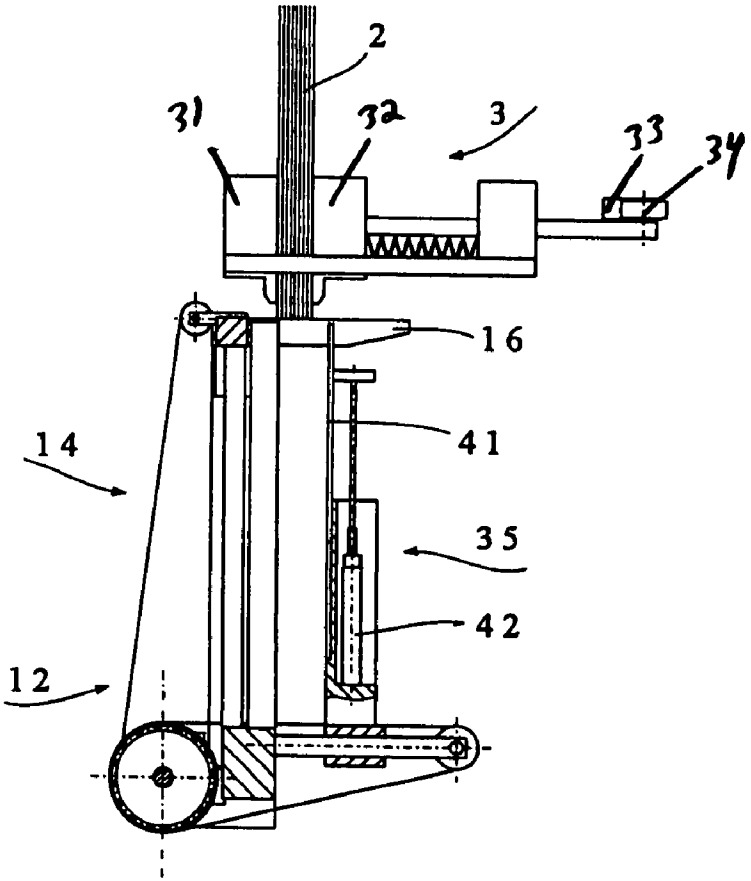
FIG. 6 illustrates a side view of the apparatus of FIGS. 3 to 5, with a book block transferred to the gripper of the perfect binder.

FIG. 6 shows the book block 2, gripped in the processing position by the closed gripper 3. The roll 34 of the gripper 3 has moved away from the control member 33. The limit stop 11 can now be lowered.

Figure 7:
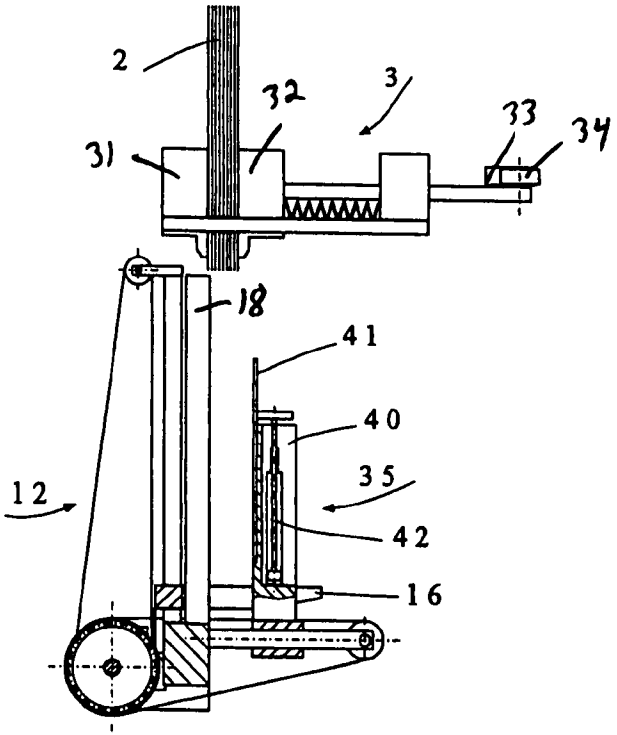
FIG. 7 illustrates a side view of the apparatus of FIGS. 3 to 6, wherein the book block is gripped by the gripper while the limit stop and guide element are retracted.

During the process of lowering the limit stop 11, the sliders 41 on the guide members 40 are retracted as shown in FIG. 7, so that the lifting device 14 does not hit the gripper 3 when the lifting device is pivoted back to the first position.

Figure 8:
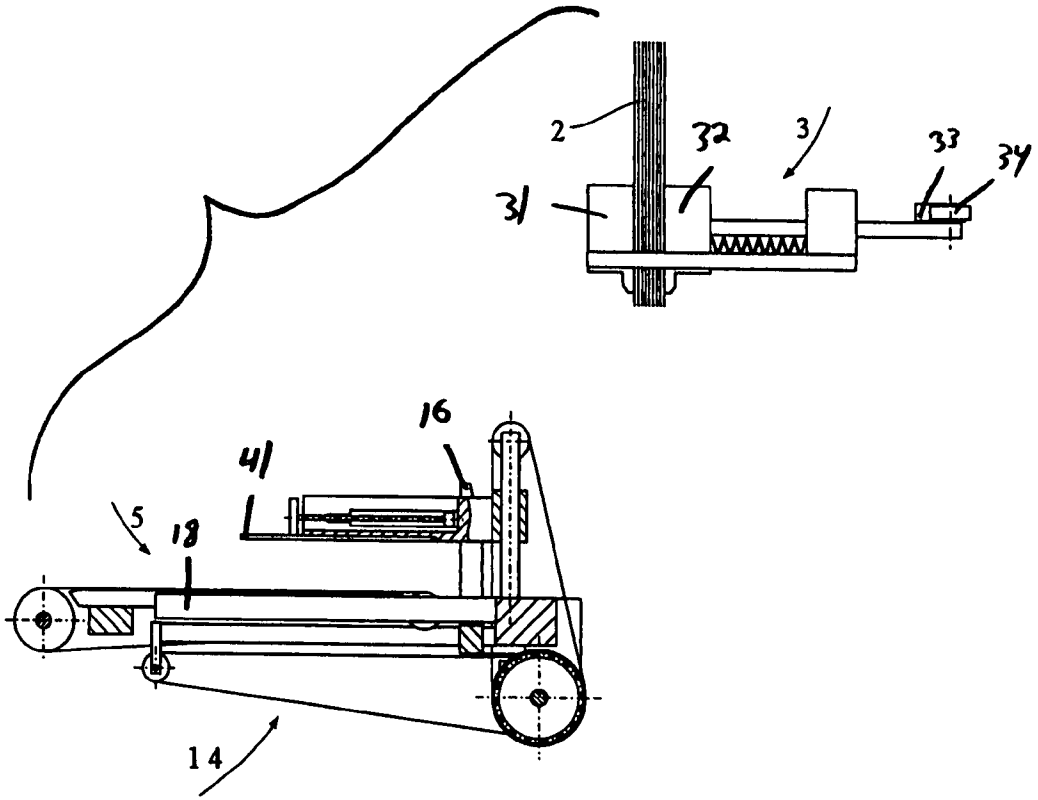
FIG. 8 illustrates a side view of the apparatus of FIGS. 3 to 6, with the lifting device in the starting position.

In FIG. 8 the lifting device 14 is again in the first position and ready to take another book block 2' from the conveying belt 4.

Figure 9:
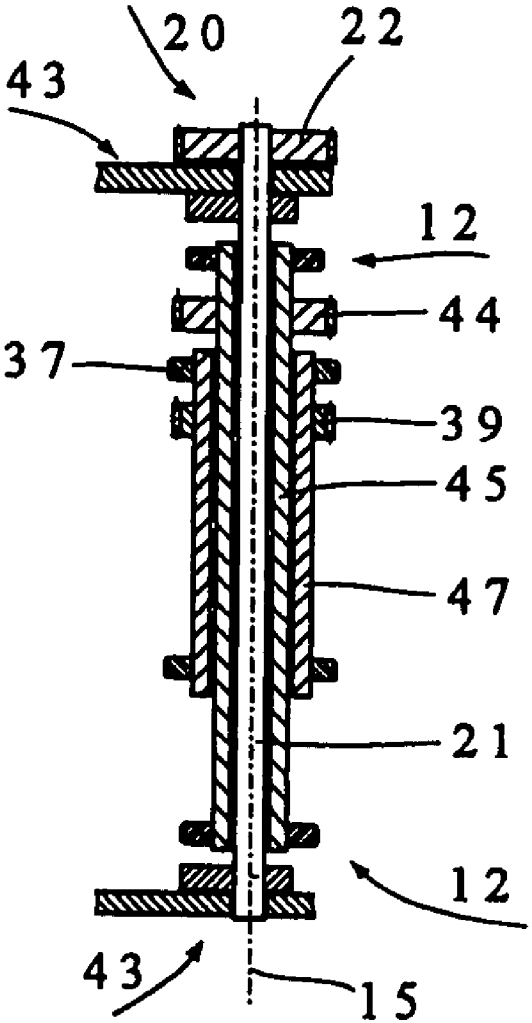
FIG. 9 illustrates a cross-section along the line A-A in FIG. 1, showing a section through a joint drive axis for the adjustment drives of the lifting device, the limit stop, and the guide element.

FIG. 9 shows the joint axis 15 that is provided for the drives of the lifting device 14, the limit stop 11, and the guide element 35. This joint axis comprises a shaft 21, positioned inside a frame 43, for the toothed wheel 22 of the toothed wheel gearing 20. The toothed wheel 22 is responsible for the pivoting movements of the lifting device 14.

An additional toothed wheel 44 is positioned on the shaft 21 and is connected to the traction mechanism drive 12 for moving the limit stop 11 and/or for lifting up a book block 2 into the gripper 3. A hollow shaft 45 is positioned on the shaft 21 to connect the toothed wheel 44 to the traction mechanism drive 12. Another toothed wheel 39 is mounted on an additional hollow shaft 47 that is attached rotatably to the hollow shaft 45 and is used with the traction mechanism drive 36 for adjusting the guide element 35. Reversing wheels for the tractions mechanism drive for adjusting the guide element 35 are connected to the hollow shaft 45.

It will be understood that the above description of the present invention is susceptible to various modifications, changes and adaptations, and the same are intended to be comprehended within the meaning and range of equivalents of the appended claims.

What is claimed is:

1. An apparatus for timed processing of book blocks for perfect binding, comprising:

a feed element to supply respective book blocks horizontally positioned with a spine facing in a feed direction of movement;

a lifting device arranged to receive the respective horizontally positioned book blocks from the feed element, the lifting device being pivotal about a horizontal axis and having an adjustably driven limit stop that forms a conveying end of the feed element; and a gripper that circulates on a traction element above the lifting device;

wherein the lifting device is pivoted about the horizontal axis into an upright position and operates synchronized with the movement of the gripper to lift the respective book blocks with the adjustably driven limit stop to transfer each respective book block to the gripper when the gripper is positioned over the book block in the lifting device.

2. The apparatus according to claim 1, wherein the gripper circulates along a circular or oval path.

3. The apparatus of claim 2, wherein a feed direction of movement of the feed element is parallel to the path of the gripper.

4. The apparatus according to claim 3, wherein the limit stop is pivotal around the horizontal axis and is adjustable perpendicular to the feed direction of movement of the book block.

5. The apparatus according to claim 4, wherein the feed element has a conveying plane and the horizontal axis about which the limit stop is pivoted is below the conveying plane of the feed element.

6. The apparatus according to claim 4, further including a traction mechanism drive for the adjustment of the limit stop in the direction perpendicular to the feed direction for the transfer of a book block to the gripper.

7. The apparatus according to claim 4, further including a toothed wheel gearing coupled to the limit stop to pivot the limit stop.

8. The apparatus according to claim 1, wherein the lifting device includes a guide arrangement forming a guide plane for the book blocks supplied by the feed element, and the limit stop is moveable along the guide arrangement.

9. The apparatus according to claim 1, wherein the limit stop comprises a plurality of fingers spaced apart from each other across a width of the feed element.

10. The apparatus according to claim 9, wherein the feed element comprises a circulating traction mechanism including a plurality of conveying sections, and the fingers of the limit stop are respectively arranged between two conveying sections of the circulating traction mechanism.

11. The apparatus according to claim 10, further including guide bars connected to the limit stop at a right angle to the fingers.

12. The apparatus according to claim 11, wherein the guide bars are respectively arranged between two sections of the circulating traction mechanisms of the feed element.

13. The apparatus according to claim 11, further including guide bars connected to the limit stop at a right angle to the fingers and forming a guide plane, and a guide member cooperating with the guide bars that form the guide plane to prevent an upright-standing book block from tilting toward the side.

14. The apparatus according to claim 13, wherein the guide member is extendible, parallel to the guide plane formed by the guide bars.

15. The apparatus according to claim 13, wherein the guide member is adjustably spaced from the guide bars by a distance that is adjustable.

16. The apparatus according to claim 15, further including a traction member drive connected to the guide member.

17. The apparatus according to claim 13, wherein the lifting device, the limit stop and the guide member have adjustment drives that have a joint drive axis.

* * * * *

UNITED STATES PATENT AND TRADEMARK OFFICE

CERTIFICATE OF CORRECTION

PATENT NO. : 7,607,882 B2
APPLICATION NO. : 11/245446
DATED : October 27, 2009
INVENTOR(S) : Matalevich et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 895 days.

Signed and Sealed this

Twelfth Day of October, 2010

David J. Kappos

David J. Kappos
*Director of the United States Patent and Trademark Office*